US007374258B2

(12) United States Patent
Bowron

(10) Patent No.: US 7,374,258 B2
(45) Date of Patent: May 20, 2008

(54) MODULAR KIOSK

(76) Inventor: Julian Bowron, 137 Beaconsfield Avenue, Toronto, Ontario (CA) M6J 3J5

( * ) Notice: Subject to any disclaimer, the term of this patent is extended or adjusted under 35 U.S.C. 154(b) by 0 days.

(21) Appl. No.: 10/055,981

(22) Filed: Jan. 28, 2002

(65) Prior Publication Data

US 2002/0194793 A1 Dec. 26, 2002

Related U.S. Application Data

(60) Provisional application No. 60/264,010, filed on Jan. 26, 2001.

(51) Int. Cl.
*A47B 81/06* (2006.01)

(52) U.S. Cl. ..... 312/7.2

(58) Field of Classification Search ..... 312/7.2, 312/257.1, 265.1, 265.2, 265.3, 326, 329, 312/223.1, 223.2, 100, 109, 138.1; 235/379, 235/381; 463/46; 40/611.05, 606.04, 606.13; D99/28; 273/138.1
See application file for complete search history.

(56) References Cited

U.S. PATENT DOCUMENTS 1,277,869 A * 9/1918 Costley ..... 40/606.13
2,054,698 A * 9/1936 Geistert et al. ..... 40/455
3,643,020 A * 2/1972 St. George et al. ..... 348/826
3,650,584 A * 3/1972 Goetz et al. ..... 312/7.2
3,728,801 A * 4/1973 Beckman et al. ..... 434/314
4,104,710 A * 8/1978 Damico et al. ..... 362/130
4,861,121 A 8/1989 Gotz
4,941,714 A * 7/1990 Seymour ..... 312/31
5,091,713 A * 2/1992 Horne et al. ..... 340/541
5,271,669 A 12/1993 Pearlson
5,348,324 A * 9/1994 Trotta ..... 280/35
5,363,150 A * 11/1994 Kojima ..... 348/836
5,483,047 A * 1/1996 Ramachandran et al. ... 235/379
5,604,341 A * 2/1997 Grossi et al. ..... 235/379
5,702,166 A 12/1997 Lee
5,761,071 A 6/1998 Bernstein et al.
5,788,348 A * 8/1998 Ramachandran et al. 312/223.1
5,956,876 A * 9/1999 Burdette et al. ..... 40/606.02
6,002,392 A * 12/1999 Simon et al. ..... 345/702
6,010,065 A 1/2000 Ramachandran et al.
6,041,310 A 3/2000 Green et al.
6,082,616 A * 7/2000 Lewis et al. ..... 235/379
6,135,884 A 10/2000 Hedrick et al.

(Continued)

FOREIGN PATENT DOCUMENTS

JP 53-133159 * 11/1978 ..... 312/223.1

*Primary Examiner*—James O Hansen

(57) ABSTRACT

An automated kiosk has (a) a cabinet; (b) a face frame releasably securable to the cabinet; (c) a plurality of cross members secured to the face frame; and (d) a plurality of hardware components releasably secured to the cross members. The hardware components may be sized and configured such that they project substantially directly inward into the cabinet when the face frame is secured to the cabinet. A method of modifying a kiosk of the invention, comprises (a) removing a hardware component or a faceplate from the kiosk; (b) repositioning a cross member on the kiosk; and (c) installing a new hardware component on the kiosk. A method of constructing a kiosk of the invention comprises (a) assembling a cabinet to a face frame; (b) receiving an order which designates the hardware components required for the kiosk; (c) securing a plurality of cross members to the face frame in a configuration suitable for receiving the designated hardware components; and (d) securing the designated hardware components to the cross members.

3 Claims, 10 Drawing Sheets

U.S. PATENT DOCUMENTS 6,178,625 B1 * 1/2001 Watson et al. ..... 29/832
6,289,326 B1 * 9/2001 LaFleur ..... 312/258
6,369,908 B1 * 4/2002 Frey et al. ..... 358/1.15
6,435,631 B1 * 8/2002 Yee et al. ..... 312/204
2002/0012337 A1 * 1/2002 Schmidl et al. ..... 370/349

* cited by examiner

MODULAR KIOSK

CROSS-REFERENCE

This patent claims priority from U.S. provisional application No. 60/264,010 filed Jan. 26, 2001, entitled Modular Kiosk.

FIELD OF THE INVENTION

The present invention relates to the field of automated kiosks.

BACKGROUND OF THE INVENTION

Electronic kiosks are devices which consist of two groups of parts, namely (1) electronic hardware components and (2) a housing for the components.

With respect to the hardware, the programmability of digital computers means that a system consisting of a monitor, with a pointing device such as a touchscreen or a touch pad and/or keyboard, and a computer (CPU), can perform a variety of functions. If the basic system is expanded by adding a printer, camera, speakers, a microphone, card readers, or other peripherals, and is connected to remote information sources by wire or wireless means, it can perform a wider variety of tasks, including e-mail, videoconferencing and database access.

The purpose of the kiosk housing is to prevent access or damage to fragile components, to draw attention to the device, and to protect sensitive components from environmental elements, thereby making it feasible to provide the equipment contained therein to the public for their use in an unsupervised setting. Access to the internal components of the housing is necessary to provide maintenance and to replenish consumable supplies, such as paper. Thus, protection of the hardware components must be ensured, while allowing access to the housing for servicing.

Kiosks are designed for specific uses. The housing is provided with mountings for the required internal components, fascia for the projection of devices such as monitors, and apertures for the introduction and removal of credit cards or the issue of printed material or cash.

Some kiosks currently available and others as described in patents may have certain modular aspects. U.S. Pat. No. 5,702,166 to Lee describes a collection of kiosks for multiple users, each kiosk designed so that they may be connected to other kiosks in an octagon-like structure. U.S. Pat. No. 5,761,071 to Bernstein et al. depicts a kiosk containing a computer arrangement, with the video display, CPU, keyboard and mouse connected by wiring.

A limitation of the prior art kiosks is that the selection of components utilized within the kiosk must be defined prior to design and fabrication of the kiosk housing. Furthermore, once the kiosk housing has been fabricated, it is not possible to change the selection of components or the relative size and shape of components without rebuilding or significantly altering the housing by cutting, grinding or re-machining. It is expensive and time consuming to design and build kiosks due to the need to create a new design for the kiosk housing each time a new set of hardware components or functions are required.

Another limitation of kiosks of the prior art is the inaccessibility of the internal hardware components for servicing. It is desirable that kiosks, which are normally located in busy areas, are as compact as possible. However, positioning a number of hardware components in a compact enclosure creates problems for servicing. U.S. Pat. No. 6,010,065 to Ramachandran et al. teaches one means to address this problem, using a service door on the kiosk and a rollout tray containing some of the serviceable components.

SUMMARY OF THE INVENTION

A kiosk housing has been invented which allows one to utilize a wide selection of different hardware components within one kiosk housing. This design allows the kiosk designer to select the desired components closer to the time that the kiosk is assembled. This new kiosk also allows one to readily change hardware components after the kiosk is in the field, without the need for cutting, grinding or re-machining.

The present invention also provides modular components supported on a service door, such that, upon opening the service door, the components are readily accessible for servicing (i.e. are no longer contained within the body of the kiosk, but are projecting from the inner face of the service door and thus are more readily accessible for servicing). The kiosk thus allows for unprecedented clear access the internal hardware components for servicing.

The present invention teaches an automated kiosk comprising (a) a cabinet; (b) a face frame releasably securable to the cabinet; (c) a plurality of cross members secured to the face frame; and (d) a plurality of hardware components releasably secured to the cross members. The hardware components may be sized and configured such that they project substantially directly inward into the cabinet when the face frame is secured to the cabinet.

In an embodiment, the edge of the face frame may be hinged to a corresponding edge of the cabinet. The cross members may be releasably secured to the face frame. At least one of the cross members may be releasably securable in a plurality of configurations in relation to the face frame. At least one of the plurality of cross members may be secured to at least one of the plurality of hardware components indirectly, such that at least one of the plurality of cross members is secured to a faceplate and the faceplate is secured to at least one of the plurality of hardware components.

One of the plurality of hardware components may be a keyboard, and the keyboard may be secured to the face frame indirectly by a keyboard housing, and the keyboard housing is secured to the face frame. The plurality of cross members may be secured to the face frame indirectly, such that the plurality of cross members is secured to a housing and the housing is secured to the face frame. There may be a plurality of housings secured to the face frame. The kiosk may have a faceplate on an upper portion of the face frame, the faceplate configured such that a top of the faceplate projects farther out from the face frame than a bottom of the faceplate.

The invention also teaches an automated kiosk comprising a cabinet, a front face frame, and a plurality of hardware components secured to the face frame. The kiosk may have a door in the kiosk, the door configured to allow access to the hardware components. The face frame may be the door.

In another embodiment, the hardware components may be secured to the face indirectly, such that the hardware components are secured to a plurality of cross members and the plurality of cross members is secured to the face frame. The hardware components may be sized and configured such that they project substantially directly inward into the cabinet when the face frame is secured to the cabinet. At least one of the cross members may be releasably securable in a plurality of configurations in relation to the face frame. In another embodiment, at least one of the plurality of cross members may be secured to at least one of the plurality of hardware components indirectly, such that at least one of the plurality of cross members is secured to a faceplate and the faceplate is secured to at least one of the plurality of hardware components. The plurality of cross members may be secured to the face frame indirectly, wherein the plurality of cross members is secured to a housing and the housing is secured to the face frame.

The invention also teaches a method of modifying a kiosk of the invention, comprising the steps of (a) removing a hardware component or a faceplate from the kiosk; (b) repositioning a cross member on the kiosk; and (c) installing a new hardware component on the kiosk.

The invention further teaches a method of constructing a kiosk of the invention comprising the steps of: (a) assembling a cabinet to a face frame; (b) receiving an order which designates the hardware components required for the kiosk; (c) securing a plurality of cross members to the face frame in a configuration suitable for receiving the designated hardware components; and (d) securing the designated hardware components to the cross members.

BRIEF DESCRIPTION OF THE DRAWINGS

A better understanding of the invention will be had by now referring to the accompanying drawings in which.

DETAILED DESCRIPTION OF EMBODIMENTS

As used herein, "kiosk housing" refers to housing which allows user access to user interface portions of hardware components while preventing public access to fragile or removable portions of the components, thereby making it possible to provide the user interface equipment to the public for their use in an unsupervised or semi-supervised setting. Service access to the internal components of the housing is necessary to provide maintenance and to replenish consumable supplies, such as paper.

Figure 1:
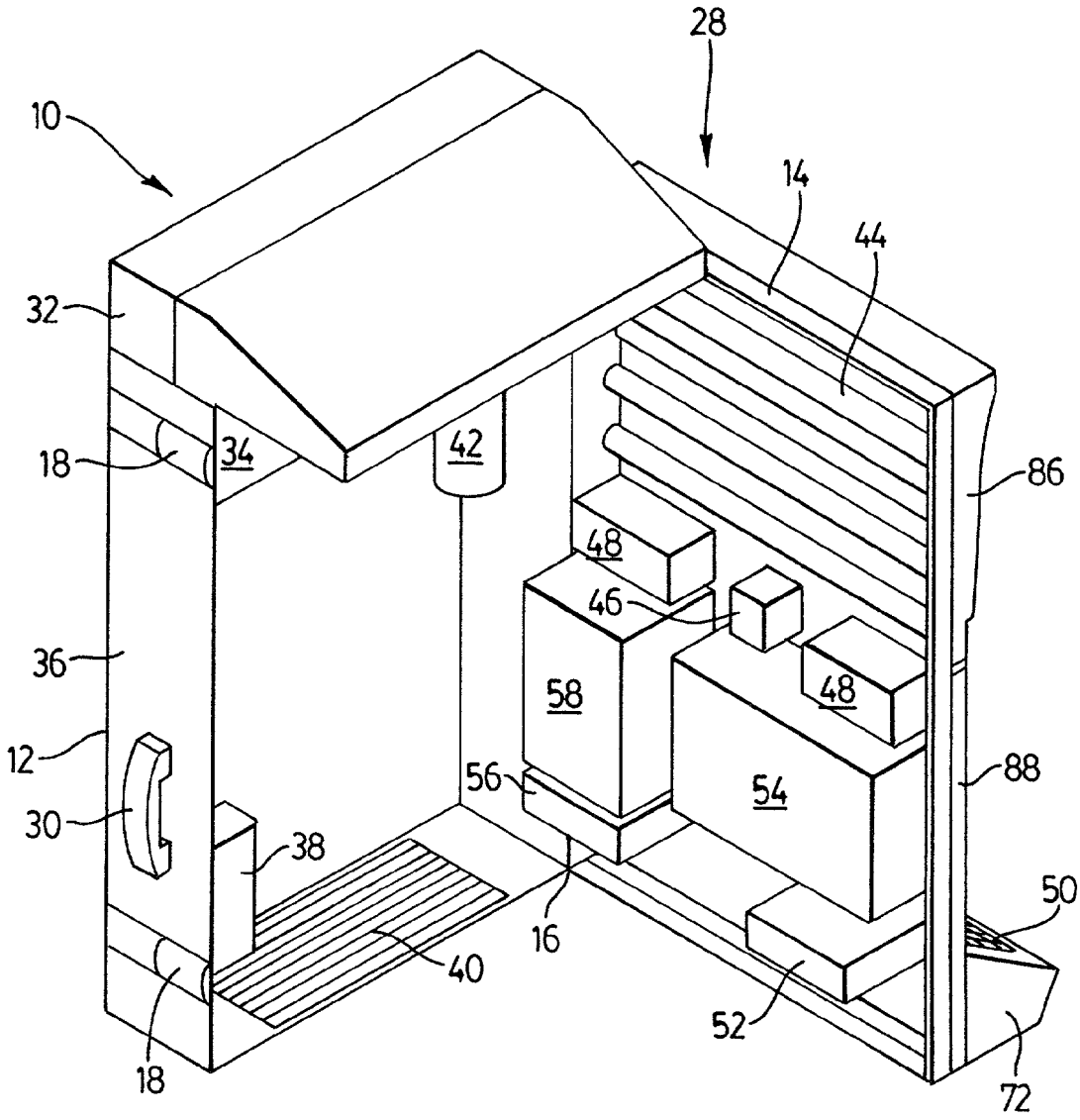
FIG. 1 is a front perspective view illustrating a kiosk of the present invention with the front door open.

As seen in FIG. 1, the kiosk housing 10 has a base cabinet 12. Fastened to cabinet 12 by a hinge 16 at one vertical edge, and fasteners 18 opposite, is face frame 14. Face frame 14 is, in turn, fastened to and supporting upper frame 86 and main frame 88. In an alternative embodiment, as shown in FIG. 8H, the face frame may be integral to main frame 88.

Figure 7:
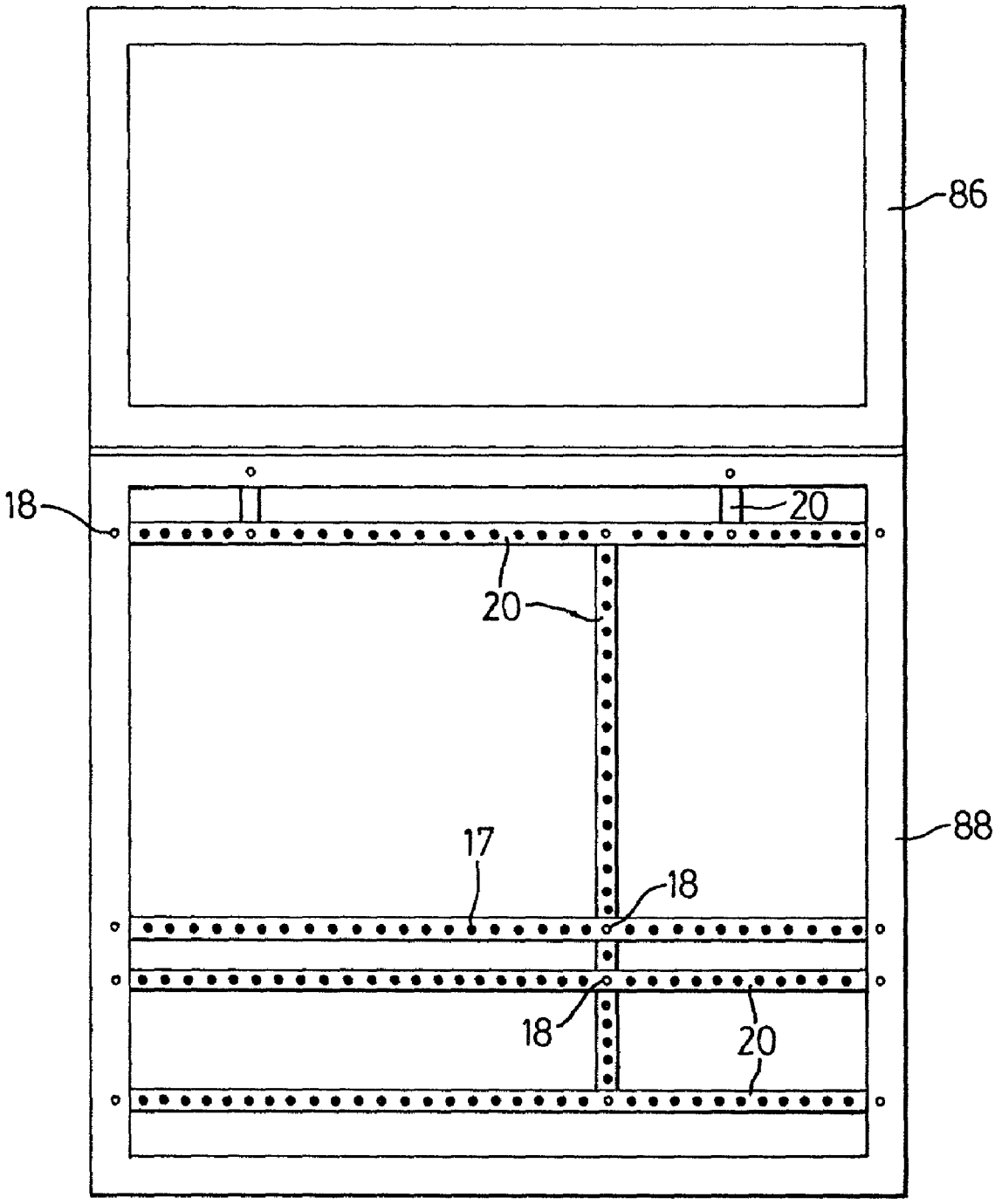
FIG. 7 is a front view of a front face frame of a kiosk of the present invention.

As seen in FIG. 7, an arrangement of cross members 20 are fastened to main frame 88 and to other cross members 20 by fasteners 18. Cross members 20 and main frame 88 thus form a grid of fastening surfaces, with openings between of a variety of dimensions, to provide for the mounting of faceplate elements. Cross members 20 are formed with a series of holes 17 running lengthwise along the cross members. Holes 17 are suitable for receiving fasteners 18. Providing the series of holes 17 facilitates reconfiguration of the cross members, allowing one to reconfigure the kiosk housing to receive different components using only simple hand tools. Faceplates 22 are fastened to cross members 20 (as seen in FIG. 8F), or main frame 88 (as seen in FIG. 8C). As seen in FIG. 8F, faceplates 22 in turn support hardware components 24, configured for access by a user to user access portions of components 24 through the faceplate 22.

Projecting inward from door 28 on a substantially horizontal plane are the bodies (i.e. non-user access portions) of various hardware components which have portions that require access for the user. Shown in FIG. 1 are the housings for the portions of speakers 48, camera 46, paper roll and printer 58, video display screen 54, data ports 56, and card reader 52. Components which do not require direct user interface, such as computer unit 34, fire suppression system 42, power supply 62, and UPS system 38 are secured within cabinet 12. The components are interconnected by wiring (not shown), and are secured to the door 28, as described above. Thus, the hardware components are independent components suitable for easy removal and replacement with like or different components, as desired.

With the cabinet 12 and face frame 14 hinged at one edge, the cabinet may be opened for servicing or the replacement of consumable materials, without requiring the disconnection of any of the components, by passing their respective conductors between the two halves of the cabinet in the vicinity of the hinge. The lock or fasteners are arranged to also provide compression of a seal which may be interposed between the edges of the rear and front cabinets, in cases where a high degree of contaminant exclusion is required.

In the illustrated case in FIG. 1, face frame 14 is fastened to and supports upper frame 86. Upper frame 86, in turn, is fastened to and supports lighting 44 (seen in FIG. 1), and graphic panel 64 via cross member 20 and faceplate 22 forming a clamp for graphic panel 64 (best seen in FIG. 8D). As an alternate method of fixing graphic panel 64, it may be fastened directly to upper frame 86, as shown in FIG. 8C. Graphic panel 64 is constructed of a semi-transparent material or the like, such as polycarbonate glazing, to allow light from lighting 44 to shine through, forming an upper backlit transparency housing.

Figure 8:
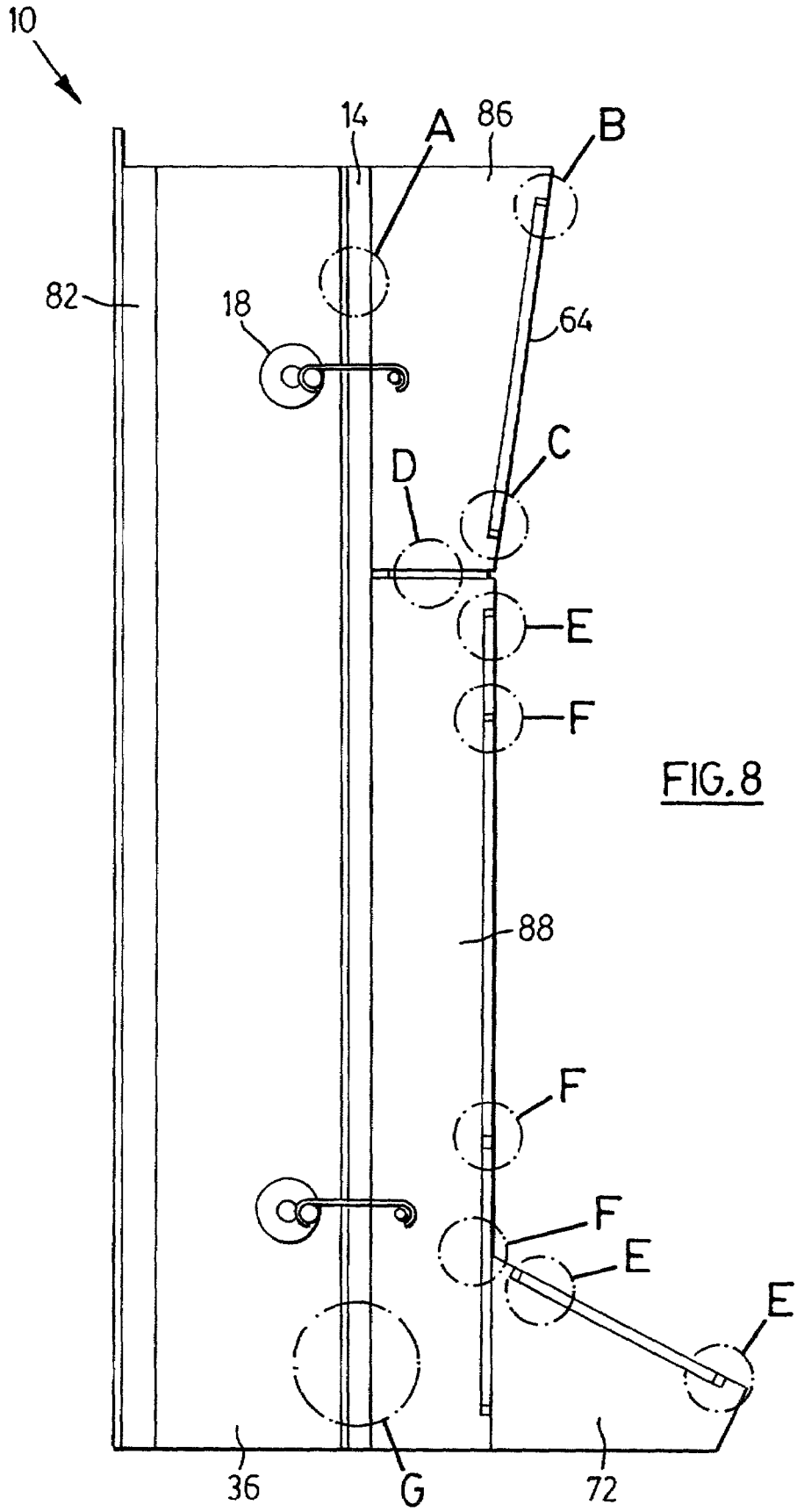
FIG. 8 is a side view of a kiosk of the present invention.
Figure 8A:
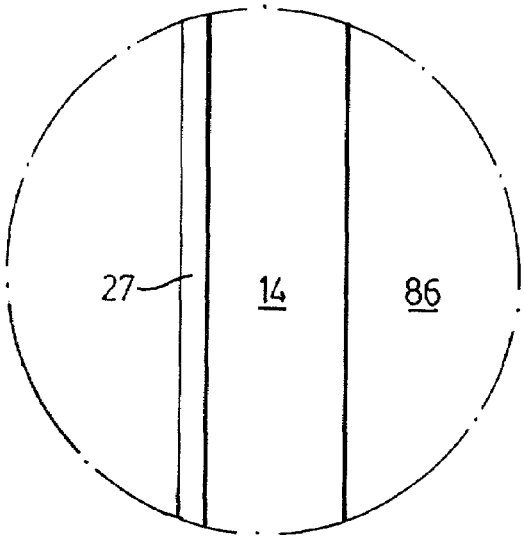
FIG. 8A is a detail view of FIG. 8 at A.
Figure 8B:
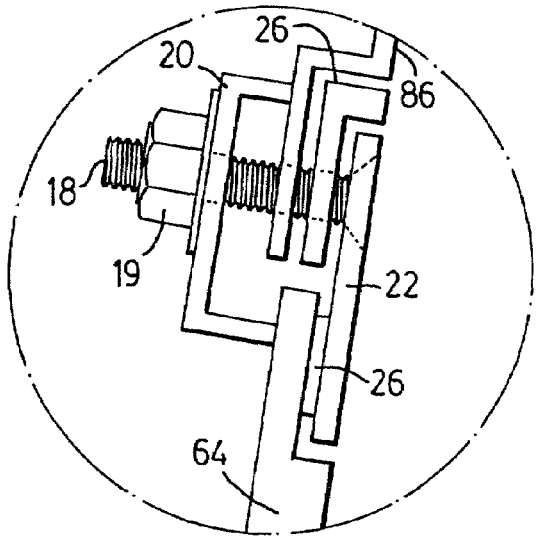
FIG. 8B is a vertical sectional detail view of FIG. 8 at B or C.
Figure 8C:
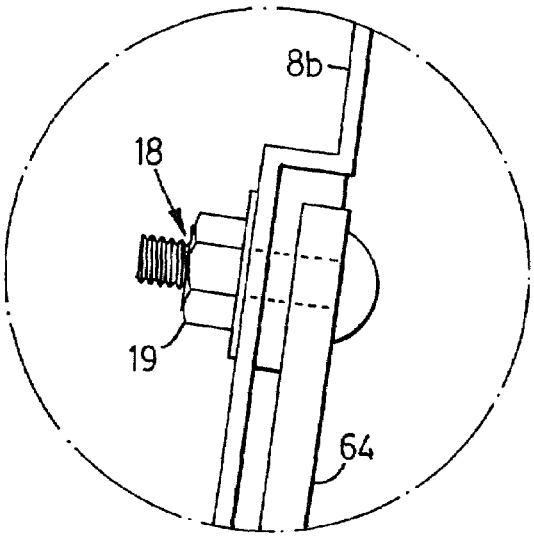
FIG. 8C is a vertical sectional detail view of an alternate embodiment of FIG. 8 at B or C.
Figure 8D:
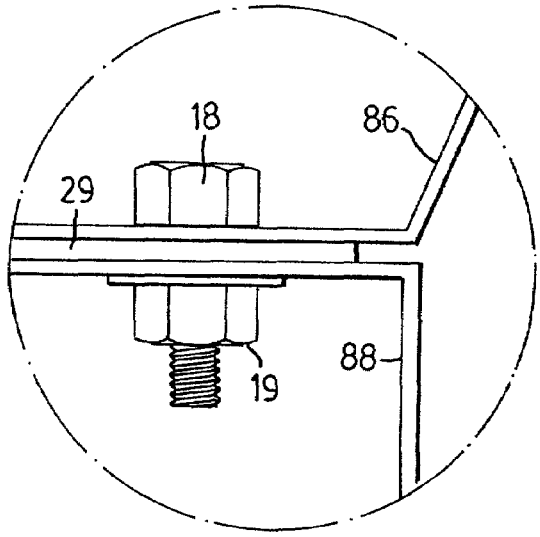
FIG. 8D is a vertical sectional detail view of FIG. 8 at D.
Figure 8E:
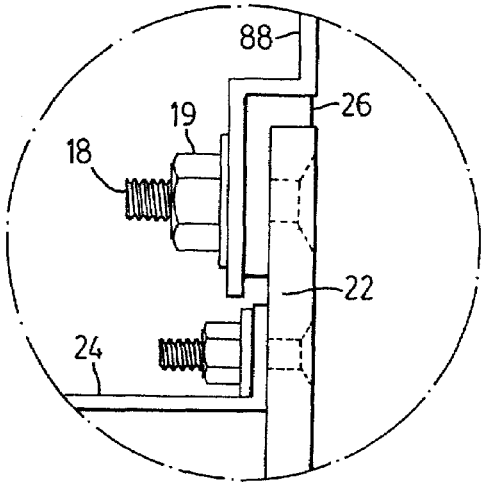
FIG. 8E is a vertical sectional detail view of FIG. 8 at E.
Figure 8F:
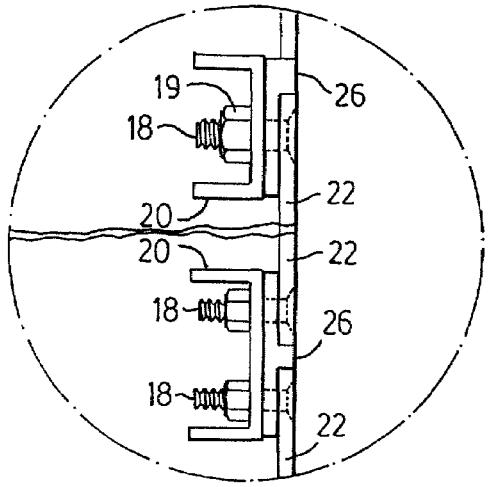
FIG. 8F is a vertical sectional detail view of FIG. 8 at 8F.

As best seen in FIG. 8, upper frame 86 is configured to allow graphic panel 64 to tilt downwards. This angle of presentation of the top (advertising) fascia allows a user to view the advertising while standing at the machine. Also seen in FIG. 8, the keyboard housing 72 is angled to project outwards to provide a more ergonomically useful keyboard surface.

Face frame 14 is also fastened to and supports main frame 88. Main frame 88, in turn, is fastened to and supports cross member 20. Cross members 20 and main frame 88, in turn, support faceplates 22 (best seen in FIG. 8F). Faceplates 22, in turn, support hardware components 24 (best seen in FIG. 8E). Main frame 88 is also fastened to and supports keyboard housing 72. Keyboard housing 72, in turn, contains keyboard 50, secured via a faceplate system such as that shown in FIG. 8.

The assembly allows for the easy addition or removal of any face frame support element and their respective faceplates. In other embodiments the face frame 14 can be further subdivided according to the present method or any similar method which suits a similar set of housing components.

As shown in FIG. 8F, cross members 20 may be flanged rigid bars forming a grid of fastening surfaces. In other embodiments, cross members 20 may be channels or tubes.

At the junction of upper frame 86 and main frame 88, these two frames are secured with fastener 18, with a gasket 29 located between the frames.

The assembly of face frame 14, main frame 88, upper frame 86, cross members 20, faceplates 22, and hardware components 24 constitute a modular door 28.

Figure 2:
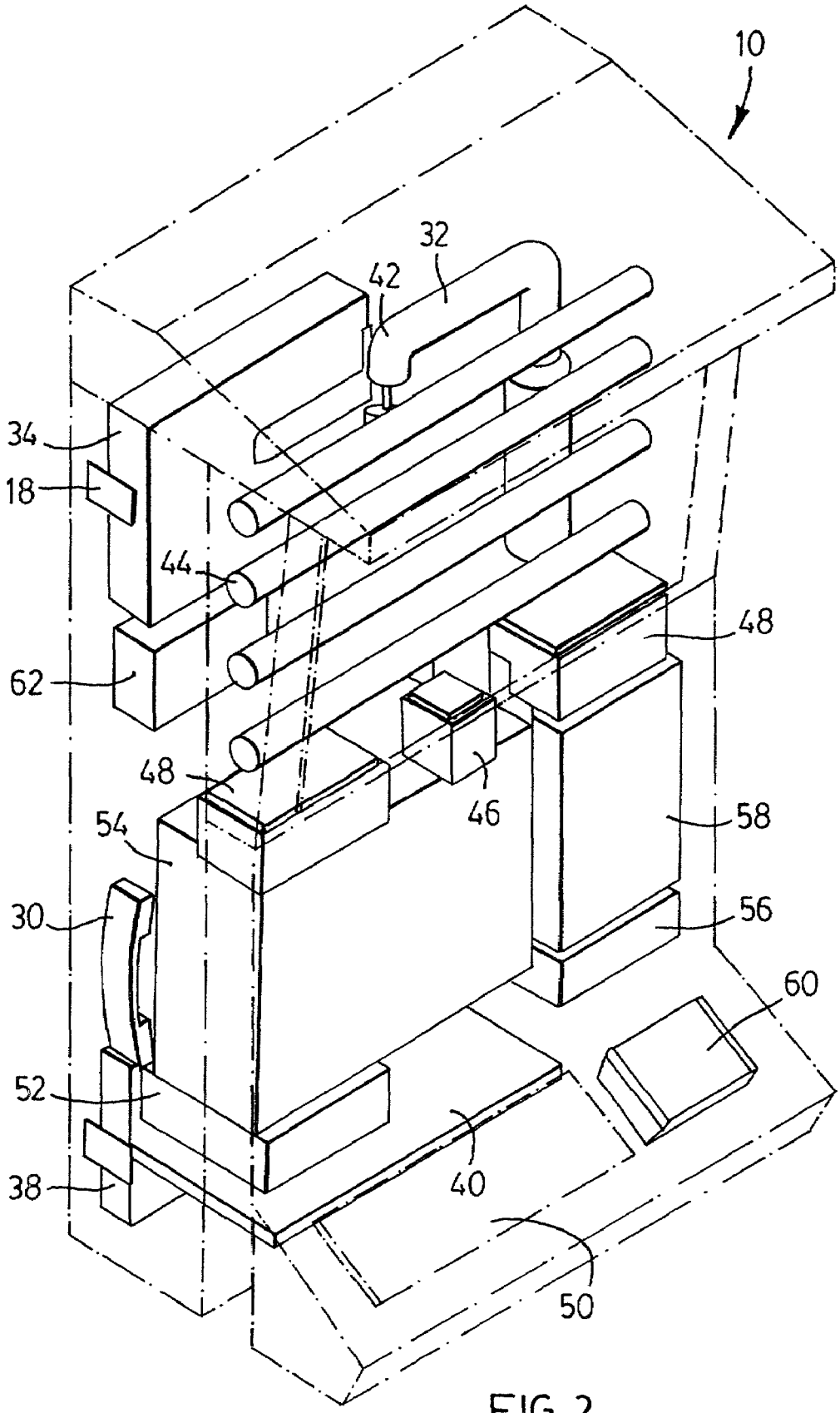
FIG. 2 is a front perspective view showing the internal configuration of a kiosk of FIG. 1 with the front door closed.

As seen in FIG. 2, the kiosk and its components are sized and configured such that, there is no interference between the front, user access door components, and the rear, cabinet installed, non-access components, nor is there interference between the walls 36 of cabinet 12 and the components secured to door 28, when the door 28 is closed.

Figure 8G:
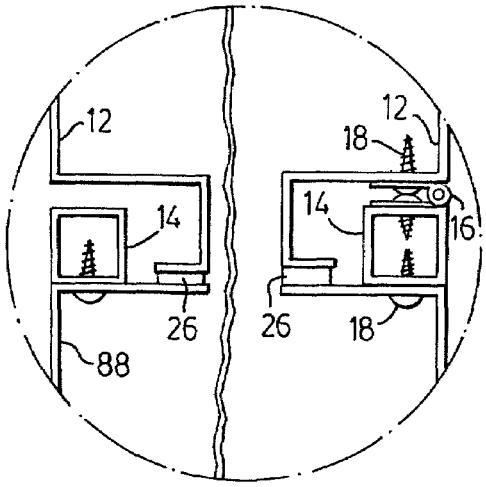
FIG. 8G is a horizontal sectional detail view of both left and right side of FIG. 8 at G.
Figure 8H:
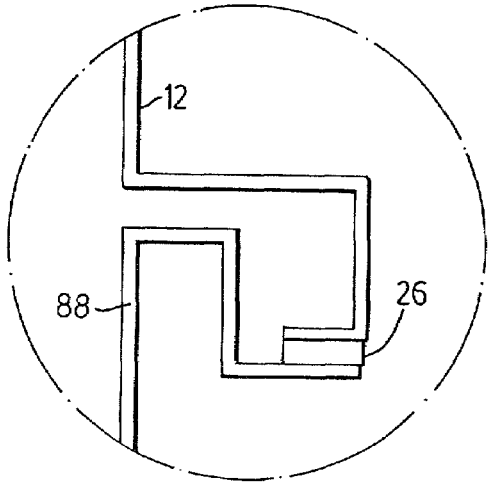
FIG. 8H is a horizontal sectional detail view of an alternate embodiment of FIG. 8 at G.

In the embodiment shown in FIG. 1 and FIG. 8G, modular door 28 is fastened to cabinet 12 with a hinge 16 at one edge, and fasteners 18 opposite. In other embodiments, door 28 may be secured to the cabinet by fasteners at all the edges. In other embodiments, hinge 16 may be located at a different edge, such as the top or bottom edge of the cabinet.

Faceplates 22 are generally flat and provide for the installation of components as described elsewhere. Such flat parts are easily fabricated by a variety of methods from any suitable sufficiently ridged material, without the need for tooling, or with simple tooling or with programmable machines.

Faceplates 22 are fastened by fasteners 18, such as studs, hooks, threaded bosses or some other arrangement on the rear surface of the faceplate 22. The securing and releasing portions (such as bolts 19) for fasteners 18 are only accessible at the rear surface of the face frame 14, which is only accessible when the cabinet is open. Any exposed portion of fastener 18 is configured to prevent tampering by using, for example, push-in studs as shown in FIG. 8E. Access to the interior of the kiosk housing 10 can be limited by the use of locks or security fasteners 18, to prevent removal of or tampering with internal hardware components by persons denied access to the necessary tools, keys, or pass cards, according to security arrangements.

A gasket 26 is interposed between the faceplates 22 and the support members 20, in order to provide a seal to prevent the entry of contaminants. Gasket 26 is constructed of a material and cross section which provides for spacing of the faceplates 22 relative to each other, allows for manufacturing tolerances, and provides a seal between the modular doors, various frames and the faceplates 22. This is achieved using a "T" section (as seen in FIG. 8F) and/or an "L" section (as seen in FIG. 8E), as appropriate, and incorporating intermediate parts, which correspond to the divisions of the cabinet face. A ribbed gasket may also be used to provide multiple seals within one length of gasket. Gasket 26 may comprise one large unibody gasket, or multiple smaller gaskets.

A gasket 27 is also located between face frame 14 and frames 86, 88 and/or 90.

The kiosk shown in FIG. 1 further has a vent and air filter 40 to provide for internal cooling while excluding dust particles and other environmental elements.

The kiosk also has a phone 30, which may be configured as a pay telephone, or as a direct access phone to, for example, a user assistance line or a taxi company.

Figure 3:
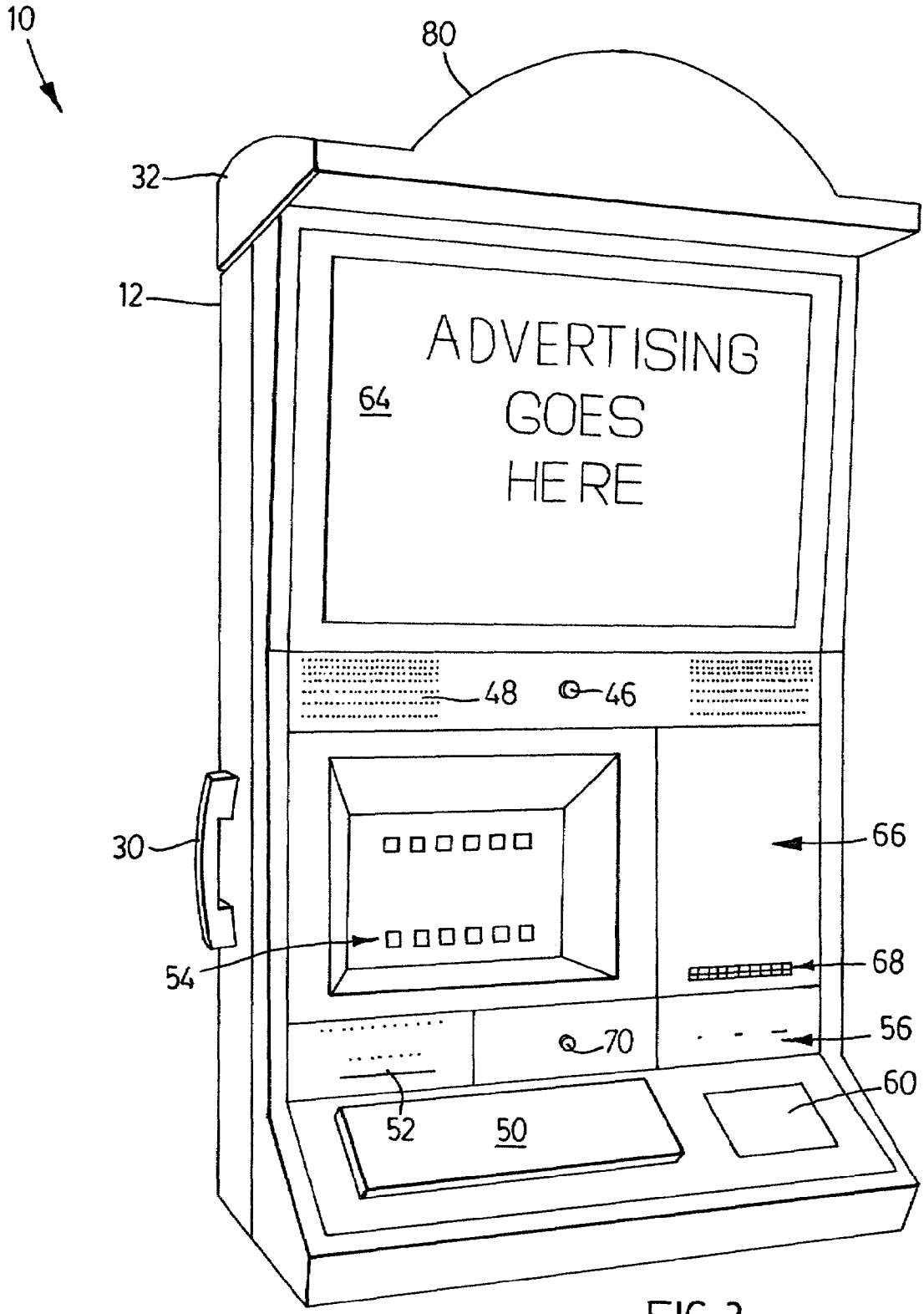
FIG. 3 is a front perspective view of a kiosk of the present invention.

The kiosk of FIG. 1 has also been provided with a cap 32 which can have multiple functions. Cap 32 protects the kiosk and shelters the kiosk user from rain, snow, sunlight and other environmental elements. Cap 32 can contain a fan (not shown) to facilitate air flow through the kiosk for cooling internal elements, or lighting for the face of the kiosk. In another embodiment of the kiosk, as shown in FIG. 3, the cap 32 can include a top display 80, which may be used for advertising, lighting, or user instruction. The cap could also be manufactured to allow for natural light to pass through and illuminate the kiosk.

FIG. 1 also shows fire suppression system 42, which integrates a smoke or heat detector with a cooling or extinguishing apparatus such as inert gas or dry chemical for extinguishing any fire caused by internal malfunction.

Figure 4:
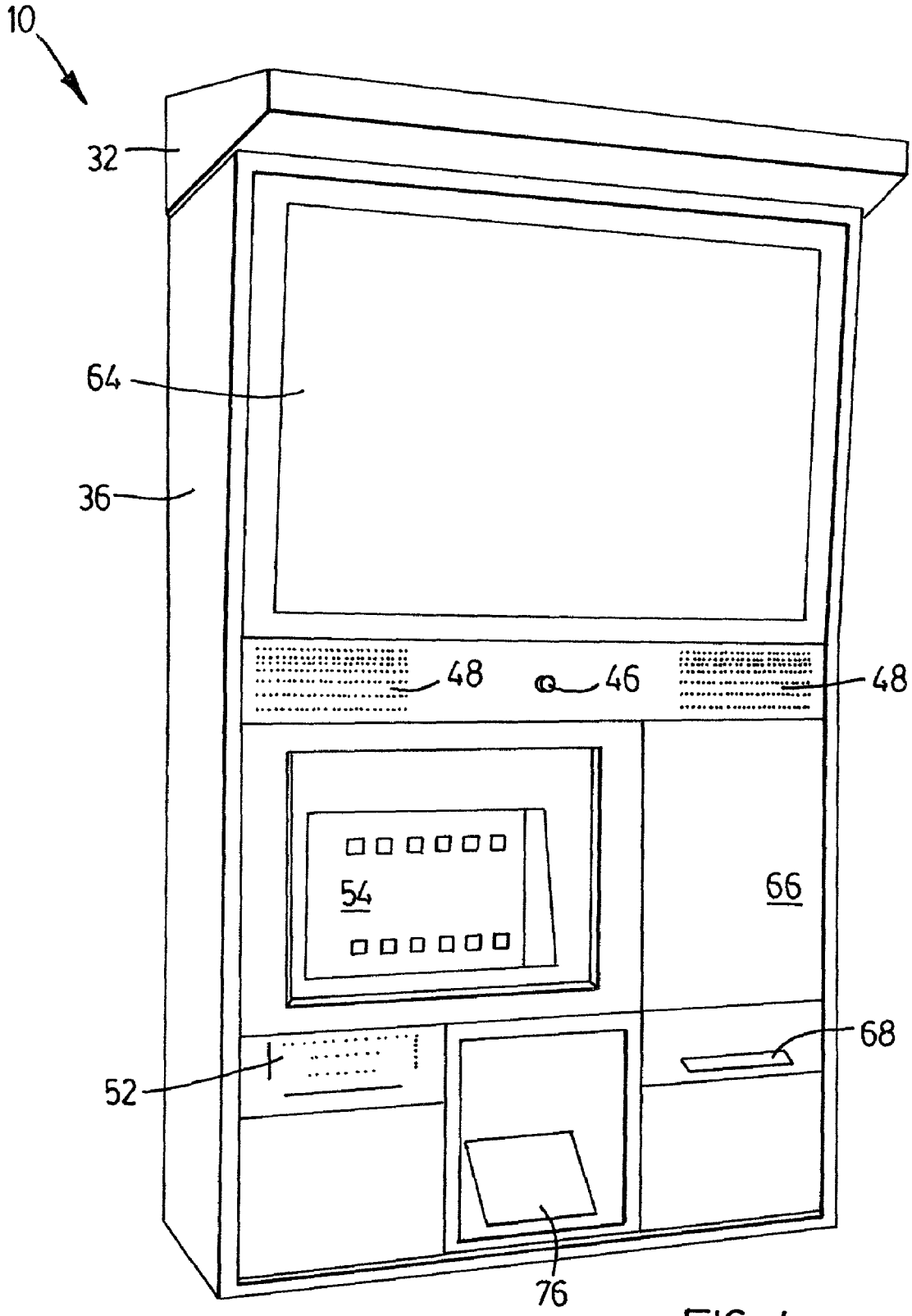
FIG. 4 is a front perspective view of an alternative embodiment of a kiosk of the present invention.
Figure 5:
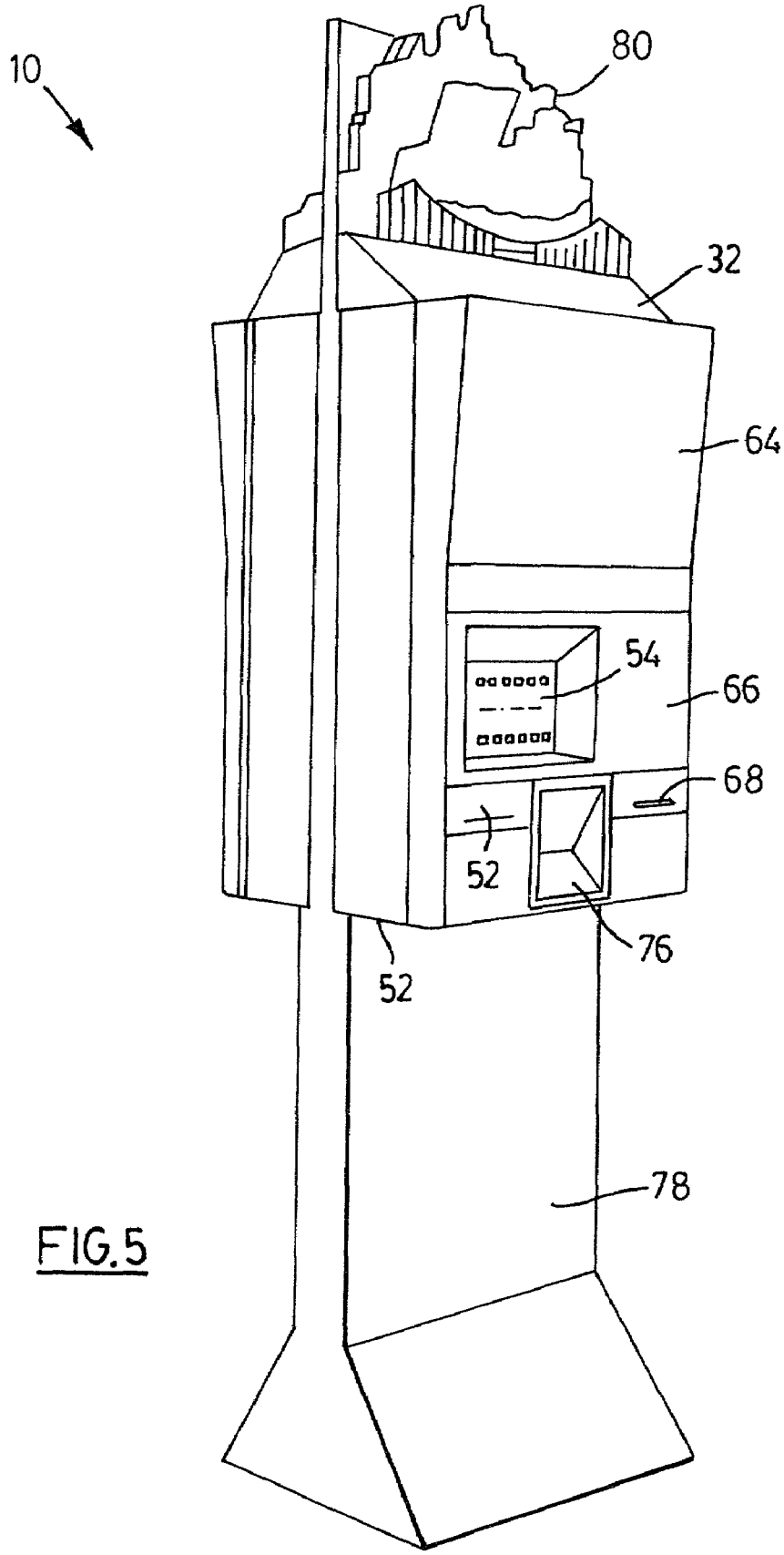
FIG. 5 is a front perspective view of a further alternative embodiment of a kiosk of the present invention.

Examples of various embodiments of the kiosks are depicted in FIGS. 3, 4, 5, and 5. All such configurations are easily constructed and may be subsequently reconfigured using the same underlying kiosk housing system described herein. Thus, the present invention provides for the selection by the end user of any subset of any components, and provides for the accommodation of still others not shown. Components that may be used as desired include printer 58, printer output 68, camera 46, speakers 48, card readers 52, keyboard 50, screen 54, data ports 56, touch pad 60, keypad 76, instruction panel 66, data ports 56, lockable maintenance port 70, as well as components not shown, such as a microphone, a mouse, key pad, track ball, and other peripherals, such as those set out in Table 1. The screen 54 can be standard, resistive touch or surface acoustic wave touch. The card reader can be a push/pull magnetic strip reader or a power loader. The camera may come equipped with a vandal shutter. The components can be connected to remote information sources by wire or wireless means. The kiosks of the invention can thus be designed to perform a wide variety of tasks, including e-mail, videoconferencing and database access. This allows the same set of housing components to accommodate hardware permitting an extremely broad range of applications, including those contemplated in Table 2 and a wide range of functions, including those contemplated in Table 3.

Figure 6:
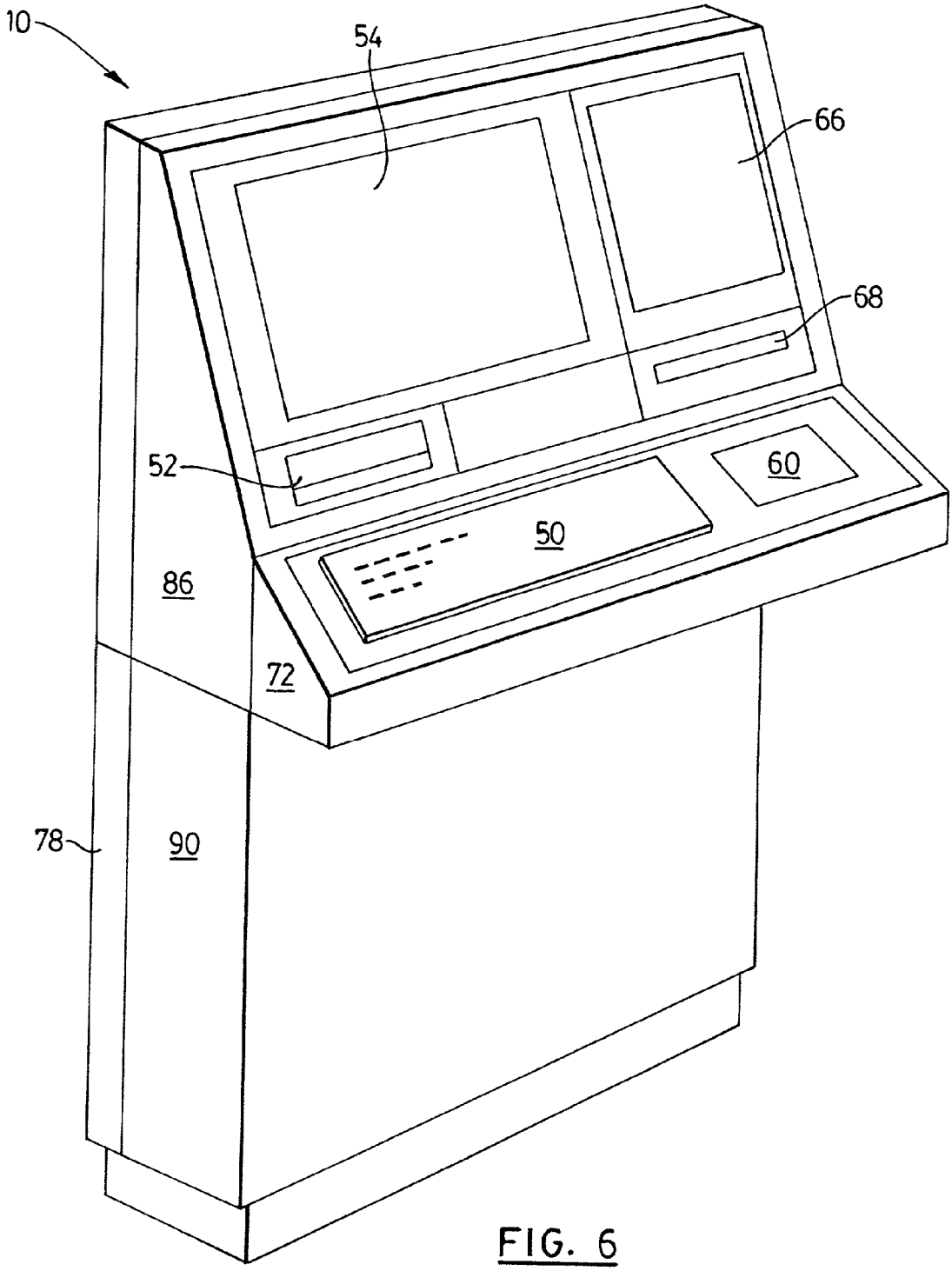
FIG. 6 is a front perspective view of a further alternative embodiment of a kiosk of the present invention.

When installed, kiosk housing 10 may be mounted directly to a vertical surface, or to a support frame 82 which is in turn fastened to the vertical surface, as shown in FIG. 8. As shown in FIG. 5, with little modification, kiosk housing 10 may also be constructed so as to extend to the ground on a free standing support stand 78. As shown in FIG. 6, kiosk housing 10 may be supported against a wall and also extent to the ground, via a lower frame 90. In this embodiment, lower frame 90 is suitable for housing computer unit 34, UPS system 38, and any other components not requiring user interface.

The invention described herein may provide all or some of the following benefits.

Firstly, for manufacturing, the rear housing, face frame and faceplate elements can be manufactured prior to the receipt of an order for a specific configuration and assembled in the requested configuration immediately prior to shipment. This reduces the time necessary to customize the configuration.

Secondly, the cost and time necessary to create and test new kiosk designs is severely reduced, allowing for more unique customized configurations, and allowing small orders to be filled.

The hardware components can be removed and replaced in the field with different sized components, or with a completely different manner of components, with minimal cost and mechanical work. The kiosk no longer has to be removed and returned to the supplier for major machining such as cutting, drilling, tapping, or otherwise altering the mountings necessary to remove a device and replace it with one having a different physical configuration. Such work can be occasioned by obsolescence of the device, a change in intended use of the configuration or other reason. Thus the kiosk housing does not have to be replaced should a component require replacement for any reason, and so has a longer useful lifespan.

The mentioned benefits are achieved without reducing the ability of the enclosure to exclude contaminants by positioning of the gasket shown in FIGS. 8 and 8A to 8H. Furthermore the interchangeable faceplates are provided with projecting studs, bosses or hooks which prevent removal of parts other than by a person with the ability to access the rear of the door, when the cabinet is open.

The present invention also provides modular components supported on a service door, such that, upon opening the service door, the components are readily accessible for servicing (i.e. are no longer contained within the body of the kiosk, but are projecting from the inner face of the service door and thus are more readily accessible for servicing).

The present invention thus provides modular fascia, each fascia attached to a corresponding modular component (e.g. monitor, keyboard, printer, card reader), with the components configured and sized to project inwards from its corresponding faceplate such that the components can be more readily removed and replaced with an updated component, a different component, or a faceplate without a component. This also allows for various combinations of components to be readily installed in the basic unit, either at the time of manufacture or later.

The kiosk also resists tampering, the elements, and provides access for maintenance and the replenishment of consumable supplies.

Thus the present kiosk housing provides for a wider range of selection of hardware components without replacing the fascia of the kiosk housing. The present kiosk housing also allows for clear access to internal hardware components for servicing. The kiosk is also lightweight, compact, easily movable, structurally rugged, and economical to manufacture. The kiosk provides a method of mounting the faceplate components to a housing in a manner which is tamper resistant. The kiosk provides a method of mounting the faceplate components to a housing in a manner which provides for protection from the elements.

The kiosk housing system may be used for many different purposes and many different hardware sets, without requiring re-design of the basic housing. The kiosk housing may be configured for its intended use at the time of its assembly. The kiosk housing may be altered subsequent to its assembly, without the need for re-working. The invention thus also teaches a fabrication method which can be applied to kiosk housings of different forms, utilizing the principles described herein.

While the present invention has been illustrated and described in detail in the drawings and foregoing description, it should be recognized that other embodiments will be apparent to those skilled in the art. It is therefore intended that the following claims cover any such embodiments as fall within the scope of the invention.

TABLE 1

Modular Kiosk Component Examples

| | Device | Options |
|---|---|---|
| 1 | 17" Monitor | Flat |
| 2 | Touch screen overlay | SAW Technology |
| 3 | Large capacity high speed printer | Thermal, Roll Fed |
| 4 | Computer | P.C. in Compact Config. |
| 5 | Network device | On Board P.C. |
| 6 | UPS | |
| 7 | Fan | With Filter |
| 8 | Thermostatic switch | Thermistor |
| 9 | Refrigeration | Semiconductor Heat Pump |
| 10 | Heating | Above, Polarity Reversed |
| 11 | Back-lit graphic | Fluorescent Lamp Lit |
| 12 | USB Webcam | With Vandal Shutter |
| 13 | TTL handset | |
| 14 | Smart card reader/loader | Push/Pull or Power |
| 15 | Mag-stripe reader | Same |
| 16 | Wide bed color printer | Dye Sub. |
| 17 | Keyboard | Vandal Resistant |
| 18 | Pin Pad | Vandal Resistant |
| 19 | Bill acceptor | |
| 20 | Speakers | 2 |
| 21 | Audio Amplifier | |
| 22 | Microphone | |
| 23 | Remote Monitoring Device | RS 232 |
| 24 | Fire Suppression System | Automatic |
| 25 | Data Ports | Telecom, Infrared, Serial |
| 26 | Pointing Device | Trackball, Touchpad |

TABLE 2

Examples of Component Subsets

| Facility Type/ Kiosk Use | Large Graphic Panel | Main Display (CRT, LCD) | Additional Display | Touch Screen | Card Swipe or POS pad | Bill Acceptor | Keyboard | Thermal printer | Plain Paper or Colour Printer | Micro-phone | Camera | Speakers | Push Buttons | Tele-phone |
|---|---|---|---|---|---|---|---|---|---|---|---|---|---|---|
| Non-Reserved Ticketing, e.g. Theatre | | | | STD | STD | OPT | | STD | | | | | | |
| Reserved Seat Ticketing, e.g. Theatre, Sports | | | OPT | STD | STD | STD | OPT | | STD | | | | | |
| Reserved Seat Ticketing, e.g. Travel | | | OPT | STD | STD | OPT | STD | STD | OPT | | | | | |
| Single Program Ticketing, e.g. Parking | | STD | | | OPT | STD | | STD | | | | | STD | |
| Facility Orientation, Utility e.g. Office | STD | | | STD | | | OPT | | | | | | | |
| Facility Orientation, ADA e.g. Institutional | STD | | | STD | | | OPT | | | OPT | | STD | | STD |
| Facility Orientation, ADA e.g. Mall | STD | | STD | STD | | | OPT | | | OPT | | STD | | STD |
| Add - bridal registry, gift certificate, vending | STD | | STD | STD | STD | STD | STD | | STD | OPT | | STD | | STD |
| Photo Kiosk | STD | STD | | OPT | STD | STD | | | STD | OPT | STD | OPT | STD | |
| E-mail Kiosk | STD | | | STD | STD | STD | STD | | STD | OPT | | OPT | | |
| Product Information Kiosk | | | | STD | | | | | OPT | | | OPT | | |
| VR Game | STD | STD | STD | | STD | STD | | | OPT | | STD | STD | STD | |

Legend:
STD = standard
OPT = optional

TABLE 3

Typical Functional Requirements

| FUNCTION | OPTIONS |
|---|---|
| Web Surfing | White listing<br>Black listing<br>"Canned" |
| Database Search | Large Memory (prob. remote), Online updating |
| Debit/Credit Card Payment | |
| Smart Card Payment/Cross Load | |
| Cash Payment | |
| Receipt Printing | |
| Page Printing | Colour<br>Black and White |
| Phone Call | TTL |
| Video Conferencing | |
| Photo Booth | Scanning |
| E-mail | Attachment Reading with Plug-ins |
| Audio Output | |
| Speech Input | |
| Remote Monitoring | |
| Remote Device Control | Shut Down<br>Boot |
| Scrolling Ads | Multiple Video Cards |
| Temperature Control | −40° C. + 55° C. ambient or Surface Temperature |
| Weather resistance | Condensing Humidity<br>Rain, Driving Rain<br>Blowing Snow<br>Dust, |
| EMI | Neither produces nor is affected by |

I claim:

1. A kiosk comprising:

(a) a cabinet;

(b) a face frame, releasably securable to said cabinet, said face frame defining an opening;

(c) a plurality of cross member connection points on said face frame;

(d) one or more hardware connection points on said face frame;

(e) a plurality of cross members, each said cross member having (i) a first end, (ii) a second end, (iii) one or more interstitial cross member connection points situated between said first end and said second end; and (iv) one or more interstitial hardware connection points situated between said first end and said second end;

at least one of said cross members releasably securable to said face frame such that the first end is secured to a cross member connection point, the second end being secured to either a second cross member connection point or to an interstitial cross member connection point located on a second cross member;

such cross members dividing said opening into at least two sub-openings;

wherein at least one cross member is releasably securable in a variety of configurations to said face frame to provide sub-areas of varying sizes, depending on said configuration, such that, in one configuration, at least one of a plurality of first hardware components having at least 3 sides and a first front face can be releasably secured to said cabinet by affixing said first hardware component to at least one hardware connection point or interstitial hardware connection point, and, in a second configuration, at least one of a plurality of second hardware components having a second front face of a size that is different than said first front face can be releasably secured to said cabinet by affixing said second hardware component to at least one hardware connection point or interstitial hardware connection point said kiosk further comprising a main frame secured to said face frame, at least another of said cross members secured to said main frame such that at least another of said cross members is secured to said face frame indirectly.

2. A kiosk comprising:

(a) a cabinet;

(b) a face frame, releasably securable to said cabinet, said face frame defining an opening;

(c) a plurality of cross member connection points on said face frame;

(d) one or more hardware connection points on said face frame;

(e) a plurality of cross members, each said cross member having (i) a first end, (ii) a second end, (iii) one or more interstitial cross member connection points situated between said first end and said second end; and (iv) one or more interstitial hardware connection points situated between said first end and said second end;

at least one of said cross members releasably securable to said face frame such that the first end is secured to a cross member connection point, the second end being secured to either a second cross member connection point or to an interstitial cross member connection point located on a second cross member;

such cross members dividing said opening into at least two sub-openings;

wherein at least one cross member is releasably securable in a variety of configurations to said face frame to provide sub-areas of varying sizes, depending on said configuration, such that, in one configuration, at least one of a plurality of first hardware components having at least 3 sides and a first front face can be releasably secured to said cabinet by affixing said first hardware component to at least one hardware connection point or interstitial hardware connection point, and, in a second configuration, at least one of a plurality of second hardware components having a second front face of a size that is different than said first front face can be releasably secured to said cabinet by affixing said second hardware component to at least one hardware connection point or interstitial hardware connection point, and wherein said face frame has a front face defining a plurality of recesses, said kiosk further comprising a plurality of faceplates having a front surface, received with said recesses and releasably secured to said face frame or said cross members such that the front surface of said faceplates is substantially parallel to said front face of said face frame, at least one of said plurality of hardware components releasably secured to at least one of said plurality of faceplates, said kiosk further comprising a plurality of gaskets for providing a seal, said gaskets interposed between said faceplates and said at least one of said cross members to which said faceplates are releasable secured.

3. The kiosk as claimed in claim 2, wherein said gasket is L shaped.

* * * * *